US009637358B2

(12) United States Patent
Knecht et al.

(10) Patent No.: US 9,637,358 B2
(45) Date of Patent: May 2, 2017

(54) MOBILE TELESCOPIC CRANE

(75) Inventors: Alexander Knecht, Zweibrucken (DE); Peter Kleinhans, Bubenreuth (DE); Tobias Ebinger, Lauf a. d. Pegnitz (DE); Andreas Hofmann, Kalchreuth (DE); Martin Lottes, Dormitz (DE)

(73) Assignee: Tadano Faun GmbH (DE)

( * ) Notice: Subject to any disclaimer, the term of this patent is extended or adjusted under 35 U.S.C. 154(b) by 654 days.

(21) Appl. No.: 13/994,377

(22) PCT Filed: Dec. 16, 2011

(86) PCT No.: PCT/EP2011/073018

§ 371 (c)(1),
(2), (4) Date: Jul. 7, 2014

(87) PCT Pub. No.: WO2012/080452

PCT Pub. Date: Jun. 21, 2012

(65) Prior Publication Data

US 2015/0008206 A1 Jan. 8, 2015

(30) Foreign Application Priority Data

Dec. 17, 2010 (DE) ..... 10 2010 063 456

(51) Int. Cl.

| | |
|---|---|
| ***B66C 23/42*** | (2006.01) |
| ***B66C 23/70*** | (2006.01) |
| ***B66C 23/36*** | (2006.01) |

(52) U.S. Cl.

CPC ..... *B66C 23/701* (2013.01); *B66C 23/36* (2013.01); *B66C 23/42* (2013.01); *B66C 23/705* (2013.01); *B66C 23/707* (2013.01); *B66C 23/708* (2013.01)

(58) Field of Classification Search

CPC ..... E04H 12/182; E04G 1/22; B66C 23/707; B66C 23/42; B66C 23/701; B66C 23/705; B66C 23/708

(Continued)

(56) References Cited

U.S. PATENT DOCUMENTS 3,494,593 A * 2/1970 Blagg ..... E21B 15/00 254/336
3,610,433 A * 10/1971 Milner, Jr. ..... B66C 13/18 212/264

(Continued)

FOREIGN PATENT DOCUMENTS

EP 1354842 A2 10/2003
GB 2387373 A 10/2003

(Continued)

OTHER PUBLICATIONS

Japanese Patent Office Action dated Jul. 28, 2015. 6 pages.
Search Report DE 10 2010 063 456.5; dated: Sep. 22, 2011; 5 pages.

*Primary Examiner* — Emmanuel M Marcelo
*Assistant Examiner* — Michael Gallion
(74) *Attorney, Agent, or Firm* — Reising Ethington P.C.

(57) ABSTRACT

A mobile telescopic crane has a telescopic jib with at least three part-jibs. Each of the part-jibs is constructed from at least two part-jib portions so as to be telescopic in a longitudinal direction. Part-jib portions arranged at a spacing from one another transverse to the longitudinal direction each form a jib portion with at least one flexurally rigid connecting element. Respective adjacent jib portions are mechanically lockable with respect to one another in the longitudinal direction. A construction of this type of the jib means that an increase in the bearing load is easily achieved by increasing the area moment of inertia of the jib.

17 Claims, 12 Drawing Sheets

(58) Field of Classification Search
USPC ..... 212/348, 350
See application file for complete search history.

(56) References Cited

U.S. PATENT DOCUMENTS

| | | | | | |
|---|---|---|---|---|---|
| 3,752,261 | A * | 8/1973 | Bushnell, Jr. | E04G 1/22 | 182/113 |
| 3,802,136 | A * | 4/1974 | Eiler | B66C 23/707 | 212/264 |
| 4,077,616 | A * | 3/1978 | Smejkal | B66F 11/04 | 266/281 |
| 4,238,911 | A * | 12/1980 | Frosch | E04H 12/182 | 182/62.5 |
| 4,327,533 | A * | 5/1982 | Sterner | B66C 23/708 | 212/292 |
| 4,590,720 | A * | 5/1986 | Reed | E04H 12/182 | 254/336 |
| 5,060,427 | A * | 10/1991 | Bernabe, Jr. | B66C 23/701 | 182/141 |
| 5,101,215 | A * | 3/1992 | Creaser, Jr. | E04H 12/182 | 343/883 |
| 5,678,708 | A * | 10/1997 | Forsberg | B66C 23/705 | 212/230 |
| 7,574,832 | B1 * | 8/2009 | Lieberman | E04H 12/10 | 212/350 |
| 8,234,823 | B2 * | 8/2012 | McClure | E04H 12/182 | 52/111 |
| 8,955,264 | B2 * | 2/2015 | Edwards | E04H 12/34 | 52/118 |
| 9,371,662 | B1 * | 6/2016 | Pereira | E04H 12/182 | |
| 2003/0079883 | A1 * | 5/2003 | McCulloch | B66C 19/00 | 166/379 |
| 2008/0236060 | A1 * | 10/2008 | Battaglia | E04H 12/182 | 52/121 |
| 2010/0005734 | A1 * | 1/2010 | McClure | E04H 12/182 | 52/111 |
| 2010/0251634 | A1 * | 10/2010 | Diniz | E04H 12/182 | 52/121 |
| 2011/0271608 | A1 * | 11/2011 | Egan | E04H 12/10 | 52/122.1 |
| 2014/0059949 | A1 * | 3/2014 | Lounis | E04H 12/182 | 52/118 |
| 2014/0158657 | A1 * | 6/2014 | Knecht | B66C 23/36 | 212/299 |

FOREIGN PATENT DOCUMENTS

| | | | |
|---|---|---|---|
| JP | 47-28652 | Y1 | 8/1972 |
| JP | S56023195 | A | 3/1981 |
| JP | 2007276918 | A | 10/2007 |
| RU | 2106295 | C1 | 3/1998 |
| WO | 2011006420 | A1 | 1/2011 |
| WO | 2011087398 | A1 | 7/2011 |

* cited by examiner

MOBILE TELESCOPIC CRANE

CROSS-REFERENCES TO RELATED APPLICATIONS

This application claims the priority of German Patent Application, Serial No. 10 2010 063 456.5, filed Dec. 17, 2010 and International Patent Application No. PCT/EP2011/073018, filed Dec. 16, 2011, pursuant to 35 U.S.C. 119(a)-(d), the content of which is incorporated herein by reference in its entirety as if fully set forth herein.

FIELD OF THE INVENTION

The invention relates to a mobile telescopic crane with a movable undercarriage, a superstructure rotatably arranged on the undercarriage, and a jib, which is telescopic in a longitudinal direction, arranged on the superstructure and is pivotable in a luffing plane.

BACKGROUND OF THE INVENTION

A mobile telescopic crane is known from EP 1 354 842 A2, which has two anchoring supports arranged on the jib and inclined with respect to the luffing plane. The anchoring supports are connected to the free end of the jib and the superstructure to increase the bearing load of the mobile telescopic crane by means of anchoring cables. As a result, loads acting laterally on the jib, which may be the bearing load-limiting criterion in an operating position of the jib, can be better absorbed. The drawback in this mobile telescopic crane is that the anchoring supports represent a substantial additional weight. The anchoring supports therefore have to be transported separately on a lorry to the construction site and assembled there on the jib. This is linked with a substantial outlay with respect to costs and time.

A material handling machine is known from GB 2 387 373 A, which has a movable machine frame and a jib, which is pivotably arranged thereon and telescopic. The jib is constructed from a plurality of jib portions, a receiving fork for a load to be moved being arranged on the outermost jib portion. The jib portions are telescopic, so the jib can be extended and retracted in order to move the receiving fork with the load arranged thereon toward the machine frame and away from it. In order to reduce the tilting moment about a front axle of the material handling machine, at least one jib portion is produced from a composite material. As a result, the weight of the jib and therefore the tilting moment about the front axle is reduced. The outermost jib portion is, for example, constructed from three part-jib portions made of composite material.

SUMMARY OF THE INVENTION

The invention is based on an object of providing a mobile telescopic crane, which easily allows an increase in the bearing load.

This object is achieved by a mobile telescopic, in which the telescopic jib has at least three part-jibs, wherein each of the part-jibs is constructed from at least two part-jib portions so as to be telescopic in the longitudinal direction, wherein part-jib portions arranged at a spacing from one another transverse to the longitudinal direction each form a jib portion with at least one flexurally rigid connecting element, and wherein respective adjacent jib portions are mechanically lockable with respect to one another in the longitudinal direction. Since the jib is constructed from at least three part-jibs arranged spaced apart from one another and flexurally rigidly connected to one another, the area moment of inertia of the jib is significantly increased. The area moment of inertia, which is a measure of the flexural rigidity, is produced according to the parallel axes theorem from the part-jibs' own proportions and their Steiner proportions. Owing to the flexurally rigid connecting elements, which connect the part-jib portions of the part-jibs into the jib portions, the jib is extremely flexurally rigid, so the cross-sectional area remains substantially level when the jib is loaded, so the Steiner proportions can be set when calculating the area moment of inertia substantially with their theoretical values, optionally by reduction ratios. In addition, in the extended operating position of the jib, a high degree of rigidity is achieved by the mechanical locking of respective adjacent jib portions, as the part-jibs constructed from the part-jib portions are extremely flexurally rigid owing to the locking. Respective adjacent part-jib portions of each part-jib can preferably be mechanically locked with respect to one another. The locking takes place, for example, by means of locking bolts, which can be actuated hydraulically, pneumatically or electromechanically. Alternatively, the locking can take place by means of a bayonet-like locking mechanism.

The at least three part-jibs ensure a high degree of rigidity of the jib both with respect to bending forces acting perpendicular to the luffing plane and also in the luffing plane. If the jib has precisely three part-jibs, they may be arranged triangularly, the rigidity over the width and height of the jib being adjustable relative to bending forces acting perpendicular to the luffing plane and in the luffing plane. The same applies when the jib has at least four, in particular precisely four, part-jibs.

Because of the significant increase in the area moment of inertia or area moments of inertia, the jib according to the invention can be dimensioned completely differently from conventional jibs, so that in comparison to a conventional jib with anchoring supports, a corresponding increase in the bearing load can be achieved with a lower additional weight. Since the part-jibs are constructed from part-jib portions that are telescopic in the longitudinal direction, the jib can be brought from a transporting position into an operating position with less effort. Owing to the lower additional weight, the mobile telescopic crane according to the invention—within a certain bearing load class—can travel with the complete jib to the construction site in the public road traffic, so no separate transportation and no laborious assembly are necessary in contrast to a jib with anchoring supports. The mobile telescopic crane according to the invention therefore easily allows an increase in the bearing load.

Moreover, the jib according to the invention can be dimensioned in such a way that, in comparison to a conventional jib with anchoring supports, a substantial increase in the bearing load can again be achieved. In this case, the jib according to the invention also has a substantial weight, so the mobile telescopic crane with the jib according to the invention can possibly no longer unrestrictedly take part in public road traffic. Individual part-jibs or a group of part-jibs or the entire jib then have to be transported separately to the construction site and assembled there. In the described dimensioning of the jib according to the invention, the advantage therefore lies in the increase in the bearing load.

A large number of optimizing parameters are provided by the number of part-jibs and their arrangement and spacing with respect to one another, so the jib according to the invention can be optimized with respect to its flexural rigidity perpendicular to and/or parallel to the luffing plane and/or with respect to weight. Depending on in which bearing load class the mobile telescopic crane according to the invention is to be, the jib according to the invention can be optimized with respect to its weight and/or with respect to its flexural rigidity or bearing load. The mobile telescopic crane according to the invention preferably has a jib with at least three, in particular at least four, and in particular at least five jib portions or respective part-jib portions.

A mobile telescopic crane, in which the jib, perpendicular to the luffing plane, has a cross-sectional area $A_A$ produced by the at least three part-jibs and each of the part-jibs, perpendicular to the luffing plane, has a part-cross-sectional area, wherein there applies to a ratio of the cross-sectional area $A_A$ to a sum $A_S$ of the part-cross-sectional areas: $A_A/A_S>1$, in particular $A_A/A_S\geq1.5$, in particular $A_A/A_S\geq2$, and, in particular $A_A/A_S\geq2.5$, ensures a high degree of rigidity of the jib with respect to bending loads. The respective part-cross-sectional area comprises the material cross-sectional area and the cavity cross-sectional area limited by the material of the part-jib.

A mobile telescopic crane, in which the jib, perpendicular to the luffing plane, has a width $B_A$ and each of the part-jibs has a width $B_i$, to the ratio of which there applies, in each case: $B_A/B_i\geq1.5$, in particular $B_A/B_i\geq2$, and, in particular $B_A/B_i\geq2.5$, has an increased rigidity with respect to bending forces acting perpendicular to the luffing plane. The width $B_A$ is a maximum width of the jib or the respective jib portion.

A mobile telescopic crane, in which the jib, parallel to the luffing plane, has a height $H_A$ and each of the part-jibs has a height $H_i$, to the ratio of which there applies, in each case: $H_A/H_i\geq1.2$, in particular $H_A/H_i\geq1.5$, in particular $H_A/H_i\geq2$, and in particular $H_A/H_i\geq2.5$, has an increased rigidity with respect to bending forces acting on the luffing plane. The height $H_A$ is a maximum height of the jib or the respective jib portion.

A mobile telescopic crane, in which the part-jibs are arranged symmetrically with respect to the luffing plane, ensures the same rigidity behavior of the jib in the positive and negative lateral direction.

A mobile telescopic crane, in which the part-jibs are arranged polygonally, in particular triangularly, with respect to one another, allows the rigidity of the jib to be optimized in relation to its weight.

A mobile telescopic crane, in which at least one part-jib is displaceable to change the cross-sectional area $A_A$, in particular to change a height $H_A$ of the jib, with respect to at least one other part-jib, ensures a compact transporting position of the jib. Owing to the possible change in the heights of the jib, when necessary, it is, in particular, ensured that the mobile telescopic crane does not exceed a maximally permissible height during travelling operation. The at least three part-jibs may, for example, be linearly movable or pivotable relative to one another. The part-jibs can be fixed with respect to one another in a displaced operating position. This takes place, in particular, by means of mechanical locking units. The mechanical locking units are, for example, arranged on the connecting elements.

A mobile telescopic crane, in which the part-jib portions of all the part-jibs are configured as hollow cylinders and adjacent part-jib portions are in each case telescopeable into one another, ensures a telescopic ability of the part-jibs. Since part-jib portions that are adjacent in the longitudinal direction can be telescoped into one another or are guided telescopically, a telescopic ability of the jib portions in conjunction with a high degree of rigidity of the jib is easily achieved.

A mobile telescopic crane, in which the part-jib portions of all the part-jibs have a geometrically similar and, in particular, an identical cross-section, is simply constructed. For example, the part-jib portions have a circular cross-section.

A mobile telescopic crane, in which respective adjacent part-jib portions of all the part-jibs are mechanically lockable with respect to one another in the longitudinal direction, ensures a high degree of rigidity of the jib, so the cross-sectional area remains level when the jib is loaded and the Steiner proportions when calculating the area moment of inertia can be set approximately with their theoretical values.

A mobile telescopic crane, in which at least two adjacent part-jib portions are mechanically lockable with respect to one another by means of at least one locking bolt, easily allows a mechanical locking of adjacent part-jib portions. The respective locking bolt can be actuated, for example, hydraulically, pneumatically or electromechanically. All the adjacent part-jib portions of each part-jib are preferably mechanically lockable with respect to one another by means of at least one locking bolt. If the jib has precisely three part-jibs, the part-jib arranged in the luffing plane is preferably mechanically lockable from the inside out, whereas the part-jibs arranged spaced apart from the luffing plane are preferably mechanically lockable from the outside in. This means that two adjacent part-jib portions of the part-jib arranged in the luffing plane are lockable in such a way that the at least one locking bolt is firstly guided for locking through the inner part-jib portion and then through the outer part-jib portion. Correspondingly the other way around, in the case of adjacent part-jib portions of the part-jibs arranged spaced apart from the luffing plane, the at least one locking bolt is firstly guided through the outer part-jib portion and then through the inner part-jib portion.

A mobile telescopic crane, in which at least two adjacent part-jib portions are mechanically lockable with respect to one another by means of at least two locking bolts, allows a rapid mechanical locking of adjacent part-jib portions. Each locking bolt has to be guided only through two associated locking bores of the adjacent part-jib portions in order to mechanically lock them with respect to one another. The path of the respective locking bolt to be covered for locking is small. Since the respective locking bolt only has to be guided through two associated locking bores, a comparatively low accuracy is necessary when aligning the respective locking bolt. Precisely two locking bolts are preferably provided, which are arranged opposing one another and can be actuated in opposing directions.

A mobile telescopic crane, in which the jib has a width that changes perpendicular to the luffing plane, the width increasing proceeding from at least one lower part-jib facing the undercarriage up to at least two upper part-jibs remote from the undercarriage, ensures a high degree of rigidity with respect to bending forces acting perpendicular to the luffing plane. If the at least two part-jibs with the largest spacing from the luffing plane were arranged on a lower side of the jib facing the undercarriage so that the width of the jib decreased proceeding from the lower side thereof to the upper side thereof, the at least two lower part-jibs would be subjected to pressure both because of the bending forces acting in the luffing plane and also because of bending forces acting perpendicular to the luffing plane. A construction of this type of the jib would lead to an undesired bearing load limitation of the jib or the mobile telescopic crane because of the double pressure loading in accordance with Euler's buckling cases. In order to avoid this, the at least two part-jibs with the greatest spacing from the luffing plane are arranged on the upper side of the jib remote from the undercarriage, so bending forces acting in the luffing plane substantially lead to a tensile loading of the at least two upper part-jibs, whereas bending forces acting perpendicular to the luffing plane lead to a pressure loading of one of the upper part-jibs. The pressure loading on the part-jibs spaced farthest apart from the luffing plane can therefore be significantly reduced. The area moment of inertia is thus, on the one hand, increased in the manner according to the invention, but, on the other hand, a double pressure loading is avoided. Owing to the width, which increases in the direction of the upper side, an optimal flexural rigidity of the jib is thus achieved with respect to bending forces acting perpendicular to the luffing plane. As the installation space in the transporting position of the jib is substantially not limited on the upper side, the width of the jib on the upper side can be dimensioned within broad ranges as required. When there are precisely three part-jibs, a lower part-jib facing the undercarriage is arranged in the luffing plane and two upper part-jibs remote from the undercarriage are arranged spaced apart from the luffing plane, so the width of the jib increases proceeding from the lower part-jib or the lower side to the upper part-jibs or the upper side. If the jib has precisely four part-jibs, these are arranged trapezoidally, so the width of the jib increases proceeding from two lower part-jibs facing the undercarriage to two upper part-jibs remote from the undercarriage. The lower part-jibs therefore have a smaller spacing from the luffing plane than the upper part-jibs. As the pressure loading decreases with the spacing from the luffing plane because of bending forces acting perpendicular to the luffing plane the flexural rigidity is also optimized with respect to bending forces acting perpendicular to the luffing plane in a jib with part-jibs arranged trapezoidally.

A mobile telescopic crane, in which the jib has precisely three part-jibs, which are arranged triangularly and symmetrically with respect to the luffing plane, has a relatively rigid and simply constructed jib.

A mobile telescopic crane, in which the part-jib arranged in the luffing plane has a larger part-cross-sectional area in comparison to the further part-jibs, ensures that the part-jib arranged in the luffing plane can be articulated in accordance with conventional jibs on the superstructure. In addition, the part-jib arranged in the luffing plane can be used as a receiving space for the hydraulic cylinder to telescope the jib. Furthermore, the part-jib arranged in the luffing plane can absorb high bending forces acting in the luffing plane because of its part-cross-sectional area $A_1$. The flexural rigidity of the jib is therefore correspondingly high. There applies to the ratio of the part-cross-sectional area $A_1$ to the part-cross-sectional area $A_2$ or $A_3$ of the further part-jibs: $A_1/A_i>1$, in particular $A_1/A_i\geq1.5$, and, in particular $A_1/A_i\geq2$ wherein i=2 and 3. There preferably applies $A_2=A_3$.

A mobile telescopic crane, in which the part-jib arranged in the luffing plane is arranged on a lower side and the part-jibs arranged spaced apart from the luffing plane are arranged on an upper side of the jib, ensures a high flexural rigidity of the jib relative to bending forces acting perpendicular to the luffing plane. Since a lower part-jib facing the undercarriage is arranged in the luffing plane and two upper part-jibs remote from the undercarriage are arranged spaced apart from the luffing plane, the width of the jib increases from the lower part-jib in the direction of the upper part-jibs. The width of the jib thus increases from its lower side in the direction of the upper side. The lower part-jib arranged in the luffing plane is substantially only subjected to pressure because of bending forces acting in the luffing plane. Bending forces acting perpendicular to the luffing plane substantially do not lead to pressure loads in the lower part-jib. In contrast to this, the upper part-jibs arranged spaced apart from the luffing plane are substantially not subjected to pressure because of bending forces acting in the luffing plane. Therefore, a double pressure loading because of bending forces acting in the luffing plane and perpendicular to the luffing plane are avoided in all the part-jibs. Owing to the arrangement of the precisely three part-jibs, on the one hand, the area moment of inertia is, on the one hand, increased in the manner according to the invention, but, on the other hand, a double pressure loading of individual part-jibs because of bending forces acting in the luffing plane and perpendicular to the luffing plane is avoided, whereby an undesired limiting of the bearing load would be provided. Accordingly, the flexural rigidity with regard to bending forces acting perpendicular to the luffing plane is optimized by the arrangement of the part-jibs. The spacing of the upper part-jibs from the luffing plane can be varied within broad ranges in the dimensioning of the jib, as the installation space on the upper side of the jib is not limited, in particular in the transporting position of the jib.

A mobile telescopic crane, in which the part-jibs arranged spaced apart from the luffing plane have the same, in particular circular, cross-sections and the same part-cross-sectional areas, ensures the same rigidity behavior of the jib in the positive and negative lateral direction. Furthermore, the jib is simply constructed.

A mobile telescopic crane, in which the part-jib arranged in the luffing plane has a cross-section, at least in portions, which is selected from the group circular and oval, allows an optimal design of the lower part-jib with respect to bending forces acting in the luffing plane. Because of the cross-section of the lower part-jib, the jib allows a higher flexural rigidity in comparison to conventional jibs in relation to bending forces acting in the luffing plane. In particular, the pressure loadability of the lower part-jib is substantially improved by the form of the cross-section in comparison to conventional jibs with a substantially rectangular cross-section. In addition, owing to the cross-section of the lower part-jib, the weight of the jib can be optimized. The lower part-jib preferably has a circular or oval cross-section over the entire part-cross-sectional area. The cross-section may, however, for manufacturing or functional reasons, for example deviate in portions from a circular or oval cross-sectional form. For example, the respective cross-section may be flattened in portions. If the lower part-jib has an oval cross-section, there applies to a maximum width $B_1$ perpendicular to the luffing plane and a maximum height $H_1$ in the luffing plane $H_1/B_1>1$, in particular $H_1/B_1\geq1.2$, and, in particular $H_1/B_1\geq1.5$. The lower part-jib preferably overlaps with the upper part-jibs in the direction of the luffing plane.

A mobile telescopic crane, in which the part-jib arranged in the luffing plane forms a receiving space, in which a hydraulic cylinder is arranged to telescope the jib, in a simple and space-saving manner, allows a telescopic ability of the jib.

A mobile telescopic crane, in which respective adjacent part-jib portions of the part-jibs arranged spaced apart from the luffing plane are mechanically lockable with respect to one another at the end, in particular the at least one locking bolt provided in each case to lock adjacent part-jib portions being arranged on the associated connecting element, ensures a high degree of rigidity of the jib relative to bending forces acting perpendicular to the luffing plane. Owing to the locking on the end side of adjacent part-jib portions of the upper part-jibs, laterally acting bending forces are guided away directly into the entire jib and absorbed thereby. This is ensured, in particular, in that the respective at least one locking bolt is directly fastened or displaceably mounted on the associated or adjacent connecting element.

A mobile telescopic crane, in which the part-jibs limit a cable guide channel, allows a simple and space-saving cable guidance.

A mobile telescopic crane, in which a support cable is guided along the jib, the support cable being arranged, in particular, in the cable guide channel, in the conventional manner ensures the lifting of loads by means of a support cable. The support cable is guided from a free end of the jib to a cable winch arranged on the superstructure. The support cable is preferably guided in the cable guide channel.

Further features, advantages and details of the invention emerge with the aid of the following description of a plurality of embodiments.

DESCRIPTION OF THE PREFERRED EMBODIMENTS

Figure 1:
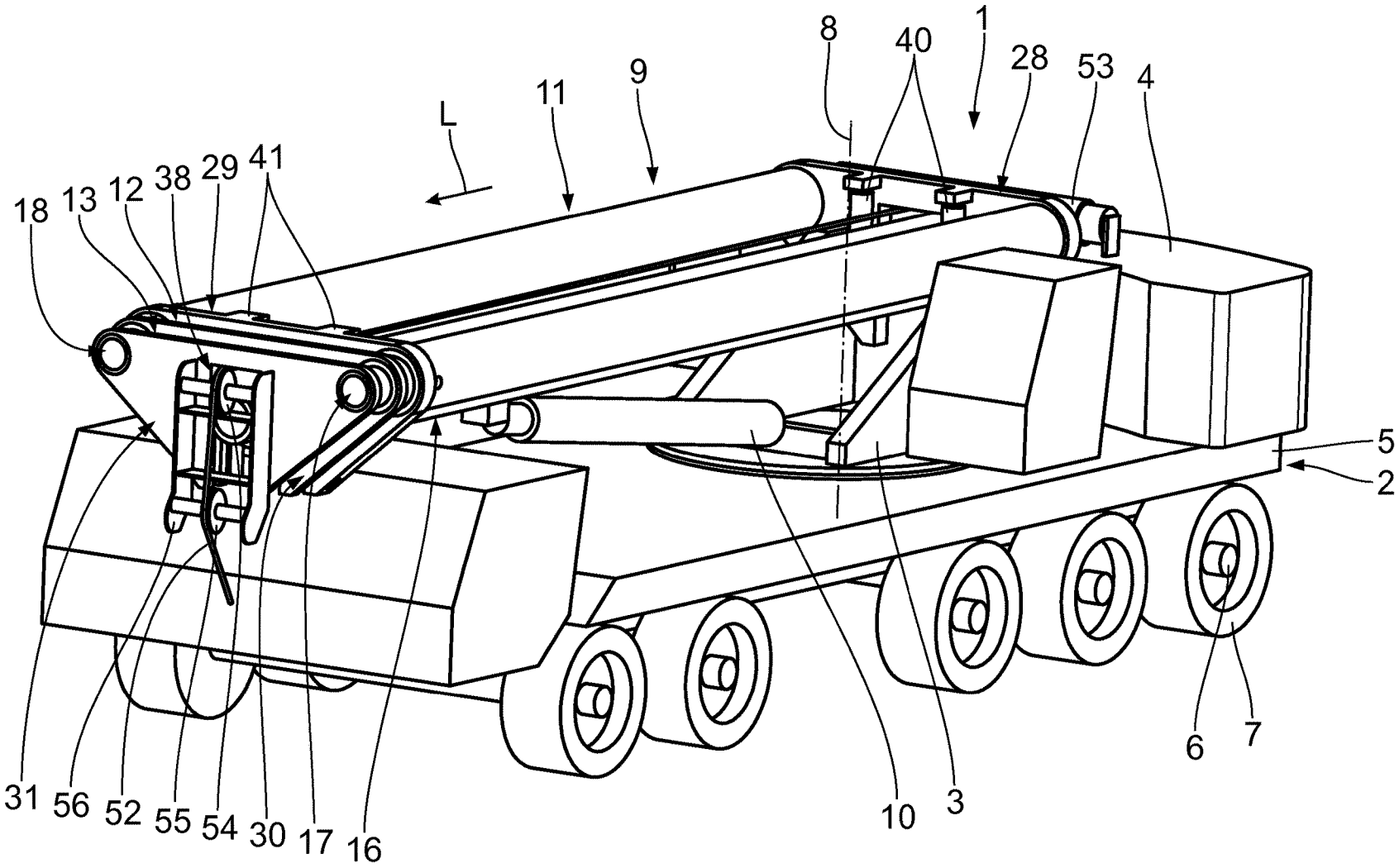
FIG. 1 shows a perspective view of a mobile telescopic crane according to a first embodiment with a telescopic jib, which is constructed from three part-jibs and is located in a transporting position.

A first embodiment of the invention will be described below with reference to FIGS. 1 to 6. A mobile telescopic crane 1 has a movable undercarriage 2, on which a superstructure 3 with a counter-weight 4 is arranged. The undercarriage 2 is configured in the conventional manner for travelling operation on public roads. For this purpose, the undercarriage 2 has a base frame 5, on which a plurality of axles 6 with wheels 7 arranged thereon, which can be driven and steered in the conventional manner, are mounted. The superstructure 3 and the counter-weight 4 arranged thereon are rotatably mounted on the undercarriage 2 about a rotational axis 8 running perpendicular to the base frame 5.

Arranged on the superstructure 3 is a jib 9, which can be pivoted by means of a hydraulic cylinder 10 in a luffing plane W and is telescopic in a longitudinal direction L. The jib 9, for this purpose, has three jib portions 11 to 13, which can be retracted and extended telescopically by means of a hydraulic cylinder 14 and can thus be transferred from a retracted transporting position into an extended operating position. The first jib portion 11 is pivotably articulated to the superstructure 3 about a horizontal pivot axis 15 at the end. The jib 9 is pivoted in the luffing plane W by means of the hydraulic cylinder 10, which, proceeding from the superstructure 3 is articulated to the jib portion 11 spaced apart from the pivot axis 15.

The jib 9 has three part-jibs 16, 17, 18, which are each constructed telescopically from three part-jib portions 19 to 21, 22 to 24 and 25 to 27. The hydraulic cylinder 14 is arranged within a receiving space of the part-jib 16, which is configured as a hollow cylinder to configure the receiving space. The part-jibs 16 to 18 are arranged transverse to the longitudinal direction L at a spacing from one another and connected to one another by four flexurally rigid connecting elements 28 to 31. The connecting elements 28 and 29 are in each case arranged at the end on the part-jib portions 19, 22 and 25 and form therewith the first jib portion 11. The connecting element is in turn arranged on the end of the part-jib portions 20, 23 and 26, which is remote from the first jib portion 11 and forms therewith the second jib portion 12. Accordingly, the connecting element 31 is arranged on an end of the part-jib portions 21, 24 and 27 remote from the second jib portion 12 and forms therewith the third jib portion 13.

The jib 9 is constructed symmetrically with respect to the luffing plane W and has a jib centre longitudinal axis 32 designated the centroidal axis and located in the luffing plane W. The part-jibs 16 to 18 accordingly have associated part-jib centre longitudinal axes 33 to 35, which are arranged polygonally or triangularly and symmetrically with respect to the luffing plane W. The centre longitudinal axes 32 and 33 are located in the luffing plane W and have a spacing $b_1=0$ perpendicular to the luffing plane W and a spacing $h_1$ from one another parallel to the luffing plane W. In comparison to this, the centre longitudinal axes 34 and 35 have the same spacings $b_2$ and $b_3$ perpendicularly from the luffing plane W. Furthermore, the centre longitudinal axes 34, 35 have a spacing $h_2$ and $h_3$ with respect to the centre longitudinal axis 32 and parallel to the luffing plane W.

Figure 6:
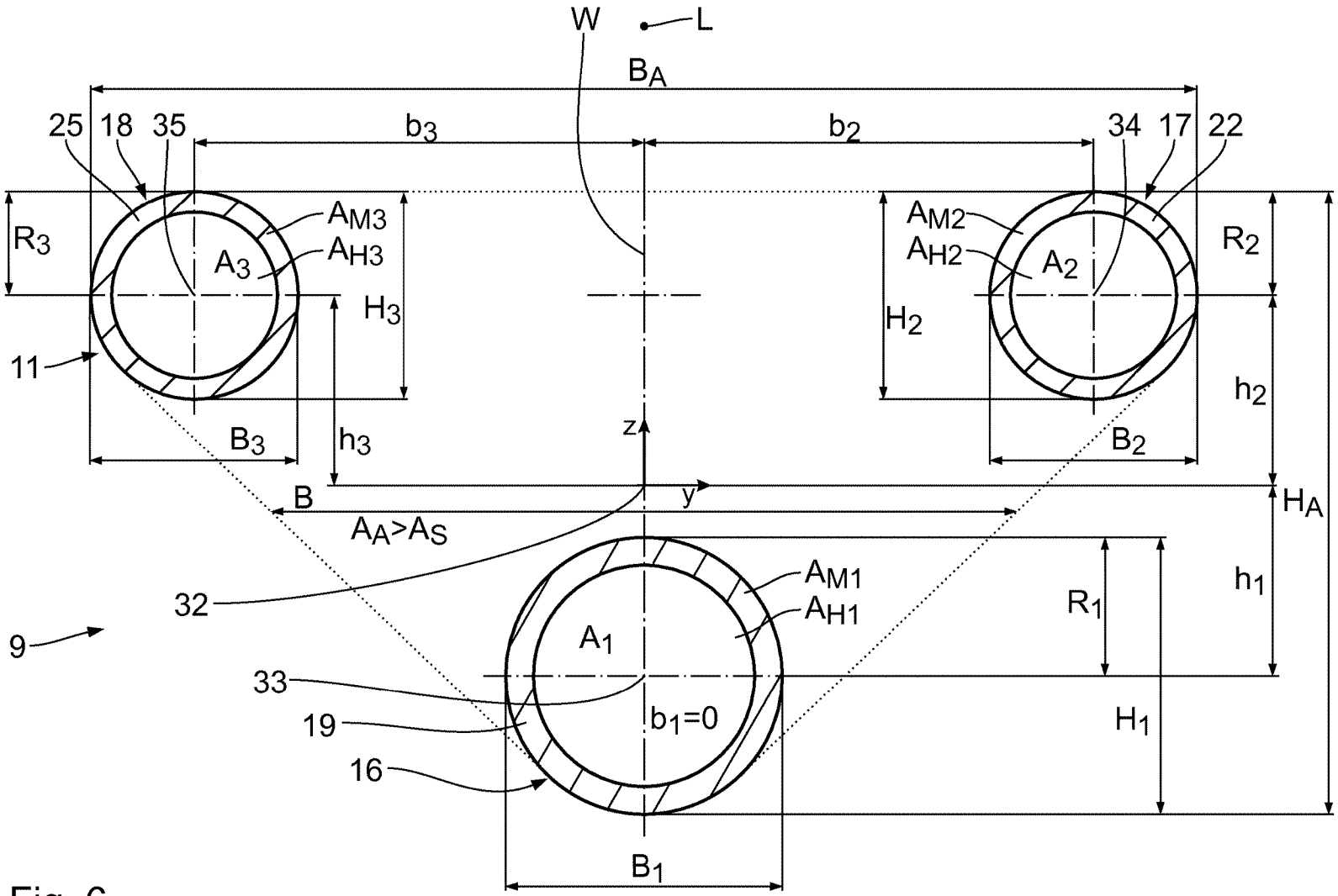
FIG. 6 shows a cross-section through the extended jib in FIG. 5 in the region of a first jib portion to illustrate the arrangement of the part-jibs.

The lower part-jib 16 arranged in the luffing plane W and facing the undercarriage 2 therefore form a lower side of the jib 9, whereas the upper part-jibs 17, 18 arranged spaced apart from the luffing plane W and remote from the undercarriage 2 form an upper side of the jib 9. The jib 9 perpendicular to the luffing plane W has a width B, which increases proceeding from the lower part-jib 16 in the direction of the upper part-jibs 17, 18 up to a maximum width $B_A$. This is illustrated in FIG. 6.

The part-jib portions 19 to 27 are configured as a hollow cylinder and have a circular cross-section. FIG. 6 illustrates the cross-sectional form of these part-jib portions 19, 22 and 25 of the first jib portion 11 and the position of the part-jib portions 19, 22, 25 relative to one another and with respect to the luffing plane W. The part-jib portion 19 has an external radius $R_1$, which is greater than the respective external radius $R_2$ and $R_3$ of the part-jib portions 22 and 25. The part-jib portion 19 therefore has a height $H_1=2\cdot R_1$ parallel to the luffing plane W and a width $B_1=2\cdot R_1$ perpendicular to the luffing plane W. Accordingly, the part-jib portions 22 and 25 have associated heights $H_2=2\cdot R_2$ and $H_3=2\cdot R_3$ and associated widths $B_2=2\cdot R_2$ and $B_3=2\cdot R_3$. The jib 9 in the region of the jib portion 11 therefore has a height or a maximum height $H_A$, which is produced from the sum of $R_1$, $R_2$, $h_1$ and $h_2$. Furthermore, the jib 9 in the region of the jib portion 11 has a width or a maximum width $B_A$, which is produced from the sum of $R_2$, $R_3$, $b_2$ and $b_3$. The same is produced for the jib portions 12 and 13, the external radii $R_1$ to $R_3$ being correspondingly smaller because of the telescopic ability of the jib 9. To telescope the jib 9, respective part-jib portions 19 to 27, which are adjacent in the longitudinal direction L, of each part-jib 16, 17 18 are guided so as to be displaceable into one another.

There applies to the ratio of the width $B_A$ to each of the widths B, wherein i=1 to 3: $B_A/B_i\geq 1.5$, in particular $B_A/B_i\geq 2$, and, in particular $B_A/B_i\geq 2.5$. Furthermore, there applies to the ratio of the height $H_A$ to each of the heights $H_i$ wherein i=1 to 3: $H_A/H_i\geq 1.2$, in particular $H_A/H_i\geq 1.5$, in particular $H_A/H_i\geq 2$, and, in particular $H_A/H_i\geq 2.5$. The same applies to the jib portions 12 and 13.

The jib portions 19, 22 and 25, perpendicular to the luffing plane W, have part-cross-sectional areas $A_1$, $A_2$ and $A_3$, which are, in each case, produced from the circular area with the associated external radius $R_1$, $R_2$ and $R_3$. The part-cross-sectional areas $A_i$ therefore in each case comprise the associated material cross-sectional areas $A_{Mi}$ and the cavity cross-sectional areas $A_{Hi}$ limited by the material, wherein there applies i=1 to 3. Owing to the spaced apart arrangement of the part-jibs 16, 17 and 18 or the part-jib portions 19, 22 and 25, the jib 9, in the region of the jib portion 11, has a cross-sectional area $A_A$, which is greater than a sum $A_S$ of the part-cross-sectional areas $A_1$ to $A_3$. The cross-sectional area $A_A$ is illustrated in FIG. 6 by the dotted lines, which in each case run tangentially between adjacent part-jib portions 19, 22, 25. The dotted lines together with the part-jib portions 19, 22, 25 form a peripheral line of the jib portion 11. The peripheral line limits the cross-sectional area $A_A$. Speaking figuratively, the cross-sectional area $A_A$ is produced in that a cable forming the peripheral line is tightly tensioned about the part-jib portions 19, 22, 25. The same applies to the jib portions 12, 13.

To the ratio of the cross-sectional area $A_A$ to the sum $A_S$ of the part-cross-sectional areas $A_1$ to $A_3$ there applies: $A_A/A_S\geq 1$, in particular $A_A/A_S\geq 1.5$, in particular $A_A/A_S\geq 2$, in particular $A_A/A_S\geq 2.5$, in particular $A_A/A_S\geq 3$, and, in particular $A_A/A_S\geq 4$. The same applies to the jib portions 12 and 13, wherein it is to be taken into account that the part-jib portions 20, 23, 26 or 21, 24, 27, because of the telescopic ability, correspondingly have smaller radii $R_1$, $R_2$ and $R_3$.

Owing to this construction, the jib 9, in comparison to conventional jibs, has a higher area moment of inertia $I_{z,tot}$ or $I_{y,tot}$ in relation to bending forces acting perpendicular to the luffing plane W and in the luffing plane W. The area moment of inertia $I_{z,tot}$ with respect to bending forces acting perpendicular to the luffing plane W, in other words upon a bend about the z-axis, is produced as:

$$I_{z,tot} = \sum_{i=1}^{n} [I_{z,i} + b_i^2 \cdot A_{Mi}], \tag{1}$$

wherein i is a continuous index for the part-jibs, $I_{z,i}$ is the part-jib i's own proportion, $b_i$ is the spacing of the centroidal axis or centre longitudinal axis of the part-jib i from the centroidal line or centre longitudinal axis of the jib in the y-direction, $A_{Mi}$ is the material cross-sectional area of the part-jib i, $b_i^2\cdot A_{Mi}$ is the Steiner proportion of the part-jib i and n is the number of part-jibs.

For the equation (1) there also applies n=3 and $b_i=0$. Equation (1) describes the achievable area moment of inertia $I_{z,tot}$ in an ideally flexurally rigid jib 9. In the practical dimensioning of the jib 9, a reduction ratio $\alpha$ is to be taken into account in the Steiner proportions and depends on the number of connecting elements 28 to 31 and their degree of flexural rigidity.

Accordingly, the area moment of inertia $I_{y,tot}$ with respect to bending forces acting parallel to the luffing plane W, in other words in the case of a bend about the y-axis is produced as:

$$I_{y,tot} = \sum_{i=1}^{n} [I_{y,i} + h_i^2 \cdot A_{Mi}], \tag{2}$$

wherein i is a continuous index for the part-jibs, $I_{y,i}$ is the part-jib i's own proportion, $h_i$ is the spacing of the centroidal axis or centre longitudinal axis of the part-jib i from the centroidal line or centre longitudinal axis of the jib in the z-direction, $A_{Mi}$ is the material cross-sectional area of the part-jib i, $h_i^2\cdot A_{Mi}$ is the Steiner proportion of the part-jib i and n is the number of part-jibs.

Corresponding with equation (1) a reduction ratio $\beta$ is to be taken into account in equation (2) in the Steiner proportions.

The area moments of inertia are a measure of the rigidity of the jib 9 relative to the respective bending forces. Because of the Steiner fractions, the area moments of inertia are substantially increased relative to conventional jibs.

The connecting elements 28 to 31 are substantially formed as triangular plates and in each case have two through-openings 36, 37 for the part-jib portions 22 to 27 of the part-jibs 12 and 13. Furthermore, the connecting elements 28 to 31 in each case have a rectangular through-opening 38 for the part-jib portions 19 to 21 of the part-jib 16, which extends approximately up to the centre longitudinal axes 34, 35. The through-openings 38 therefore form a cable guide channel 39 in the connecting elements 28 to 31 to guide a support cable 52. The support cable 52 is guided in the conventional manner from the free end of the jib 9 to a cable winch 53 arranged on the superstructure 3. The support cable 52 is guided on the free end of the jib 9 over two deflection rollers 54, 55, which are rotatably mounted on the free end of the jib 9 by means of a support frame 56.

Figure 2:
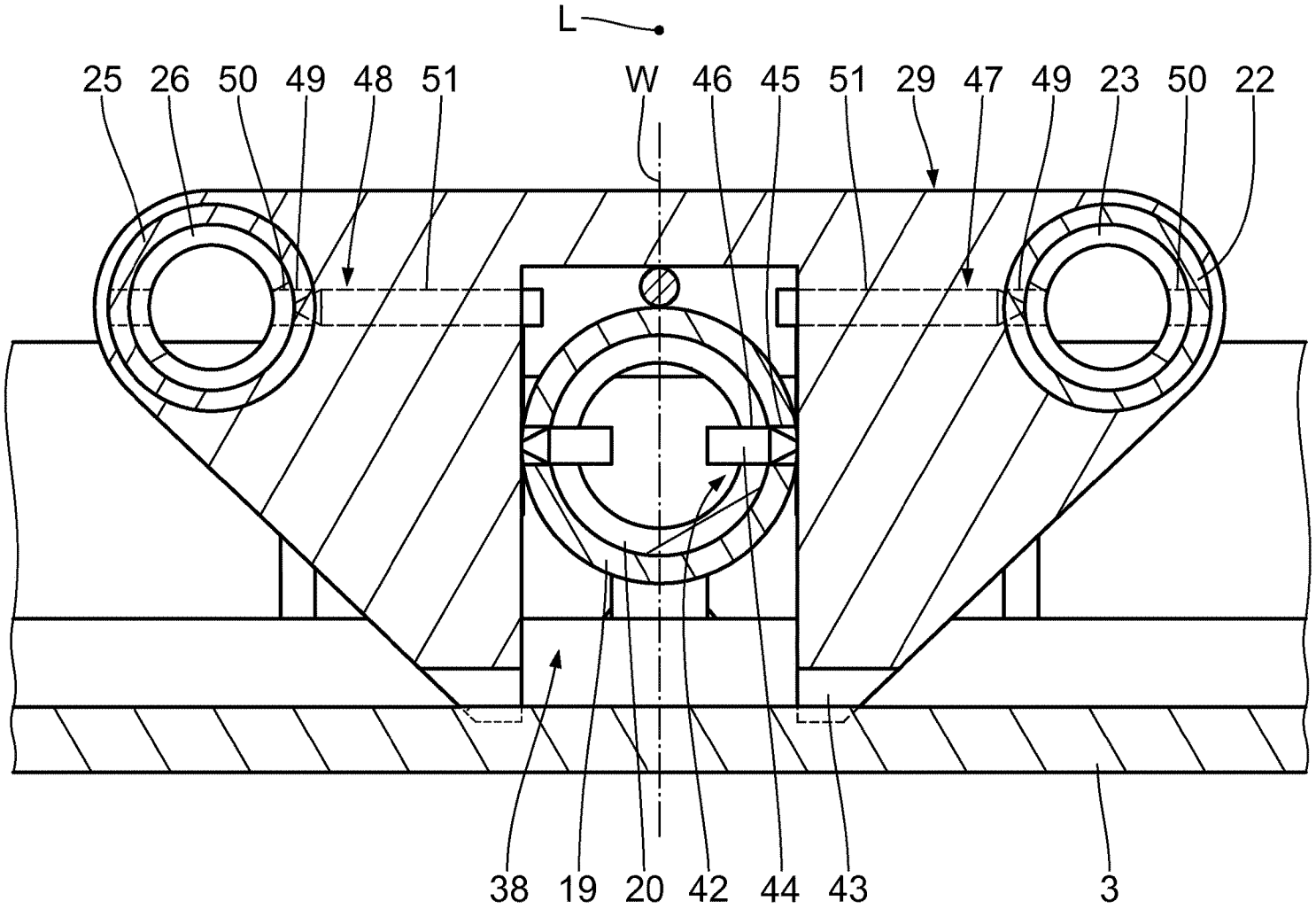
FIG. 2 shows a cross-section through the jib in FIG. 1 in the region of a connecting element.
Figure 5:
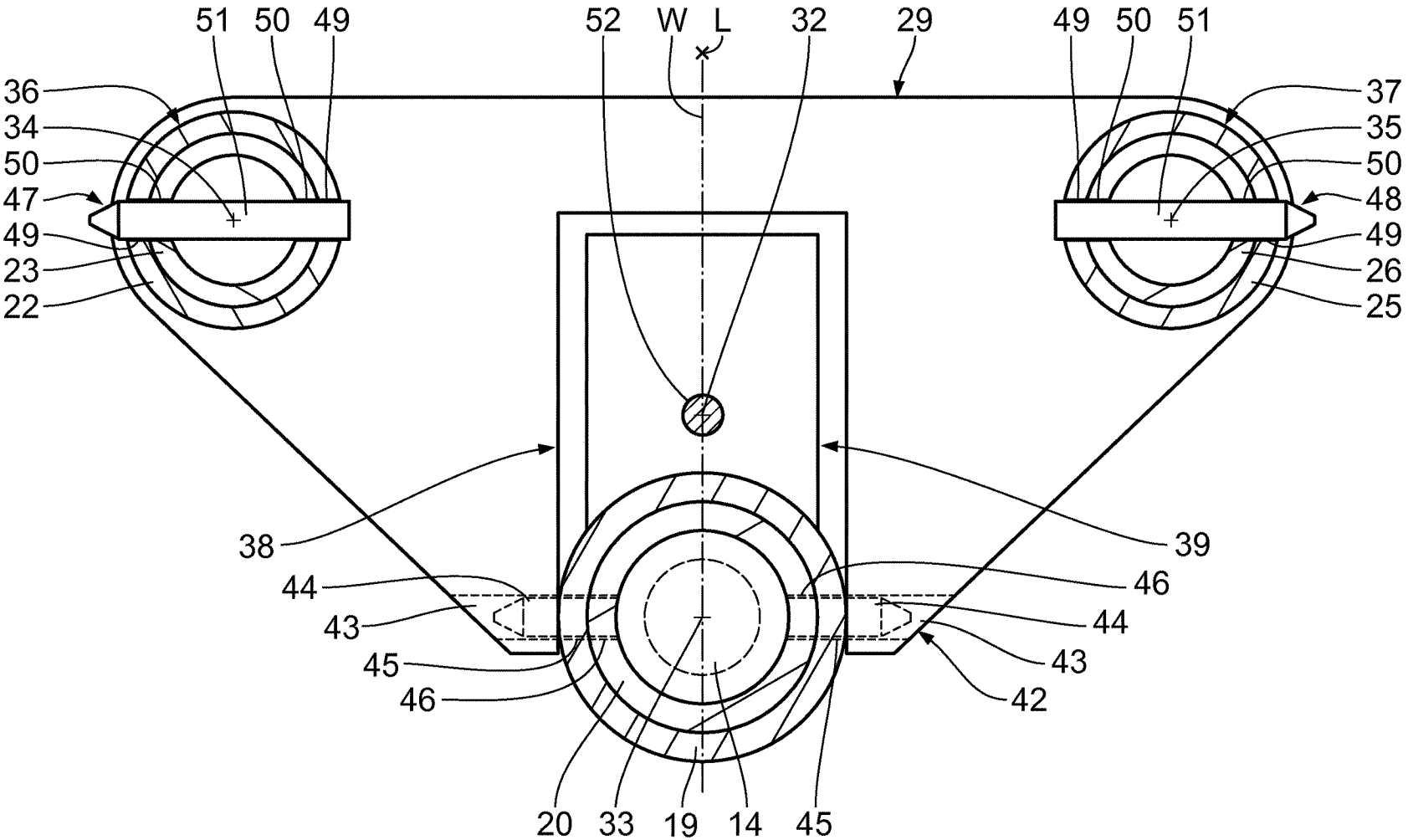
FIG. 5 shows a cross-section through the jib in FIG. 4 in the region before the connecting element.

The part-jibs 17 and 18 can be displaced relative to the part-jib 16 parallel to the luffing plane W. For this purpose, two hydraulic cylinders 40 are rigidly arranged on the end facing the superstructure 3 on both sides of the part-jib portion 19 and connected to the connecting element 28. Accordingly, two hydraulic cylinders 41 are fastened at the end on the part-jib portion 19 and are connected to the connecting element 29. To displace the part-jibs 17, 18 or to fix these part-jibs 17, 18 relative to the part-jib 16, locking units 42 are provided. The locking units 42 are integrated into the part-jib portions 19 to 21 and the associated connecting elements 28 to 31. FIGS. 2 and 5, by way of example, show the locking unit 42 associated with the part-jib portion 19 and with the connecting element 29. The locking unit 42 has two locking bores 43, arranged in an opposing manner, opening into the through-opening 38 and running perpendicular to the luffing plane W. Locking and unlocking are possible owing to associated locking bolts 44, which can be guided through locking bores 45 of the part-jib portion 19 and the locking bores 43. The locking bolts 44 can be actuated, for example, hydraulically, pneumatically or electromechanically.

The jib 9 can be transferred from a transporting position into an operating position and vice versa by the hydraulic cylinders 40, 41 and the locking units 42. In the transporting position, the cross-sectional area $A_A$ or the height $H_A$ of the jib 9 is reduced in comparison to the operating position, so the mobile telescopic crane 1 has a lower overall height. The reduction in the overall height is necessary, for example, to not exceed a maximally permissible height in road traffic.

In addition, the locking units 42 belonging to the connecting elements 29 and 30 have locking bores 46, through which the locking bolts 44 can also be guided. The locking bores 46 are in each case configured in the inner part jib portion 20 or 21, so, in the locked state, the adjacent part-jib portions 19 and 20 or 20 and 21 are locked in the longitudinal direction L.

For locking in the longitudinal direction L, locking units 47 and 48 are furthermore provided and are arranged in the region of the connecting elements 29 and 30. The locking units 47 and 48 are mounted or fastened directly on the respectively associated connecting element 29 or 30. The locking units 47, 48 in each case have locking bores 49, 50, which are configured in the adjacent part-jib portions 22 and 23, 23 and 24, 25 and 26 and 26 and 27. A respective locking bolt 51 can be guided through the locking bores 49, 50, so the desired mechanical locking of the jib portions 11 and 12 and 12 and 13 can be achieved. Alternatively, corresponding to the locking units 42, two locking bolts 51 can be provided, which are arranged opposing one another and can be displaced in respective associated locking bores 49, 50. The locking bolts 51 can be actuated, for example, hydraulically, pneumatically or electromechanically.

FIGS. 1 and 2 show the mobile telescopic crane 1 in the state provided for travelling operation. The jib 9 is in a completely retracted transporting position. The locking units 42, 47 and 48 are unlocked and the jib portions 11 to 13 are retracted telescopically. Furthermore, the part-jibs 17 and 18 are completely lowered by means of the hydraulic cylinders 40, 41, so the part-jib 16 is completely arranged in the through-openings 38. In this state, the mobile telescopic crane 1 has the smallest possible overall height, so the maximally permissible height in road traffic is not exceeded. FIG. 2 illustrates the transporting position of the jib 9 with the aid of a cross-section through the connecting element 29.

Figure 3:
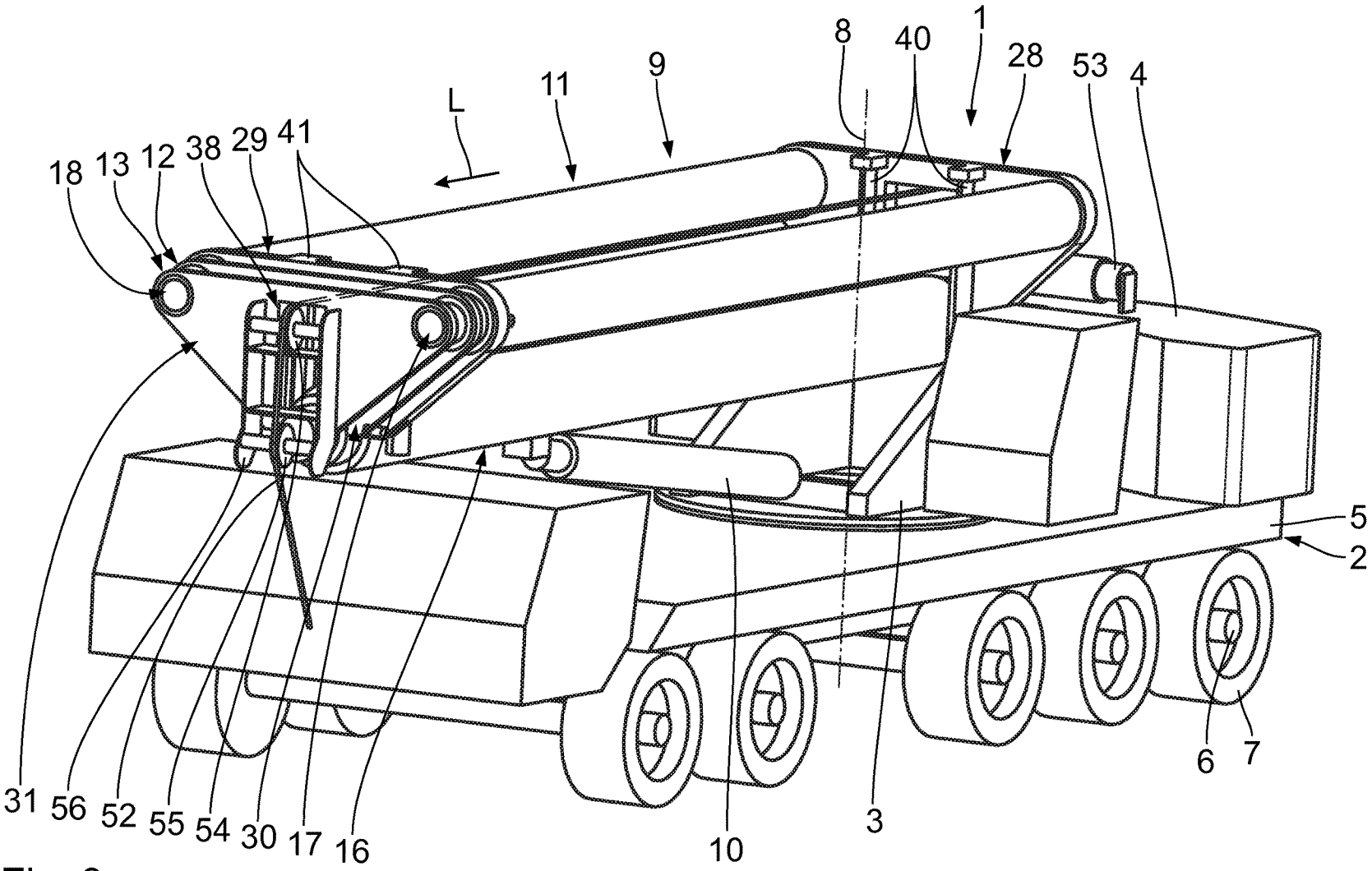
FIG. 3 shows a perspective view of the mobile telescopic crane in FIG. 1 with the jib located in a retracted operating position.

FIG. 3 shows the mobile telescopic crane 1 with the jib 9 in a telescopically retracted operating position. By means of the lifting cylinders 40, 41, the part-jibs 17, 18 and the connecting elements 28 to 31 have been extended relative to the part-jib 16 parallel to the luffing plane W. The locking units 42 belonging to the connecting elements 28 and 31 are then locked.

Figure 4:
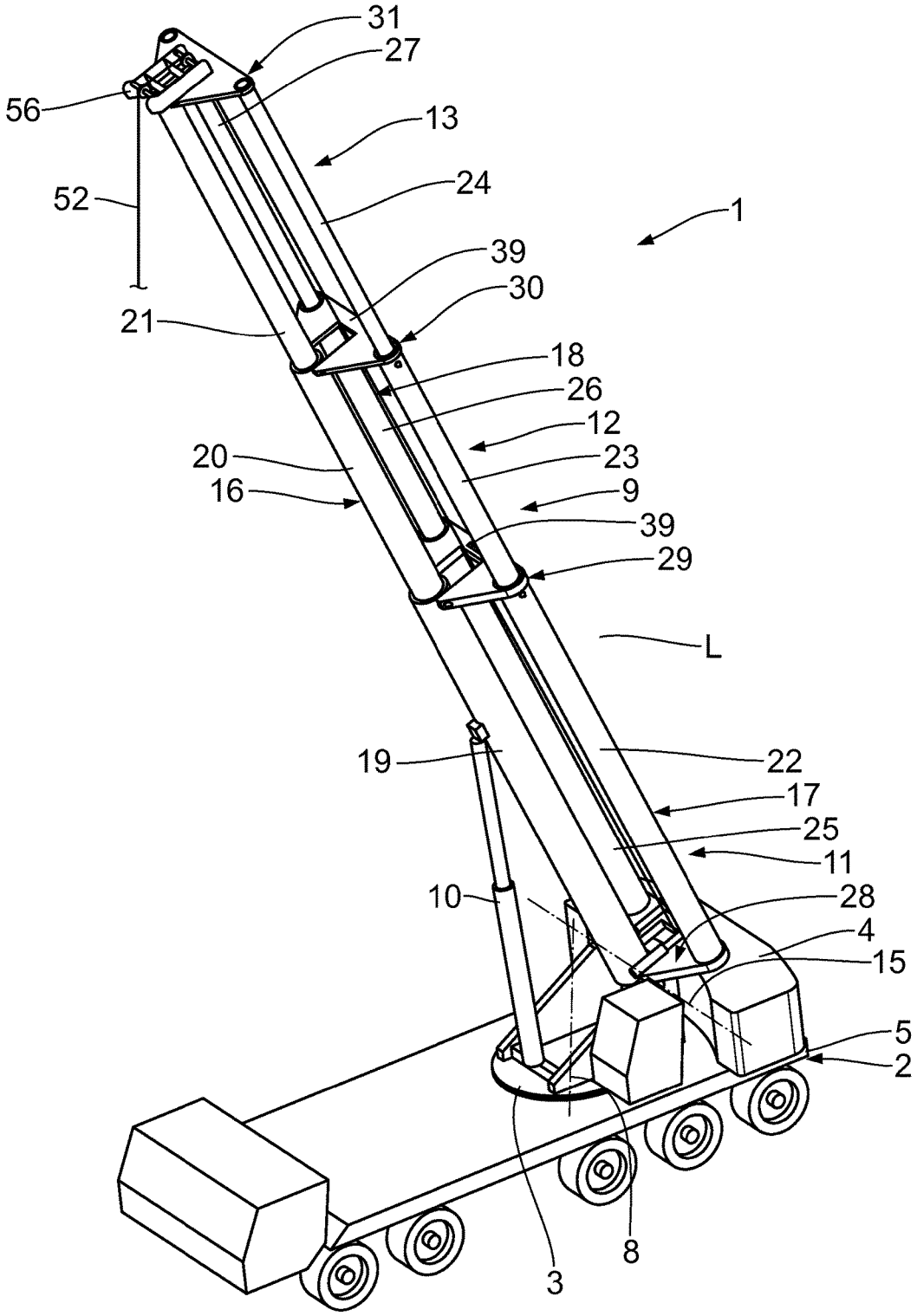
FIG. 4 shows a perspective view of the mobile telescopic crane in FIG. 1 with the jib located in an extended operating position.

The jib 9 is thereupon erected in the luffing plane W by means of the hydraulic cylinder 10 and telescopically extended by means of the hydraulic cylinder 14. FIG. 4 shows the mobile telescopic crane 1 in an operating position with the completely erected and telescopically extended jib 9. In this state, the locking units 42, 47 and 48 belonging to the connecting elements 29 and 30 are also locked, so the jib 9 has a high degree of rigidity. FIG. 5 shows a cross-section through the locking units 47, 48 adjacent to the connecting element 29.

The jib 9 according to the invention, because of the high area moments of inertia, has a high degree of rigidity with respect to bending forces perpendicular and parallel to the luffing plane W. As a result, in relation to the weight of the jib 9, a substantial bearing load increase can be achieved. In particular, the jib 9, even without an increase in weight compared to conventional jibs, or with only a slight increase in weight, has a significant bearing load increase, which approximately corresponds to that of a conventional jib with anchoring supports. However, compared to a conventional jib with anchoring supports, no separate transportation and no laborious assembly are necessary.

Figure 7:
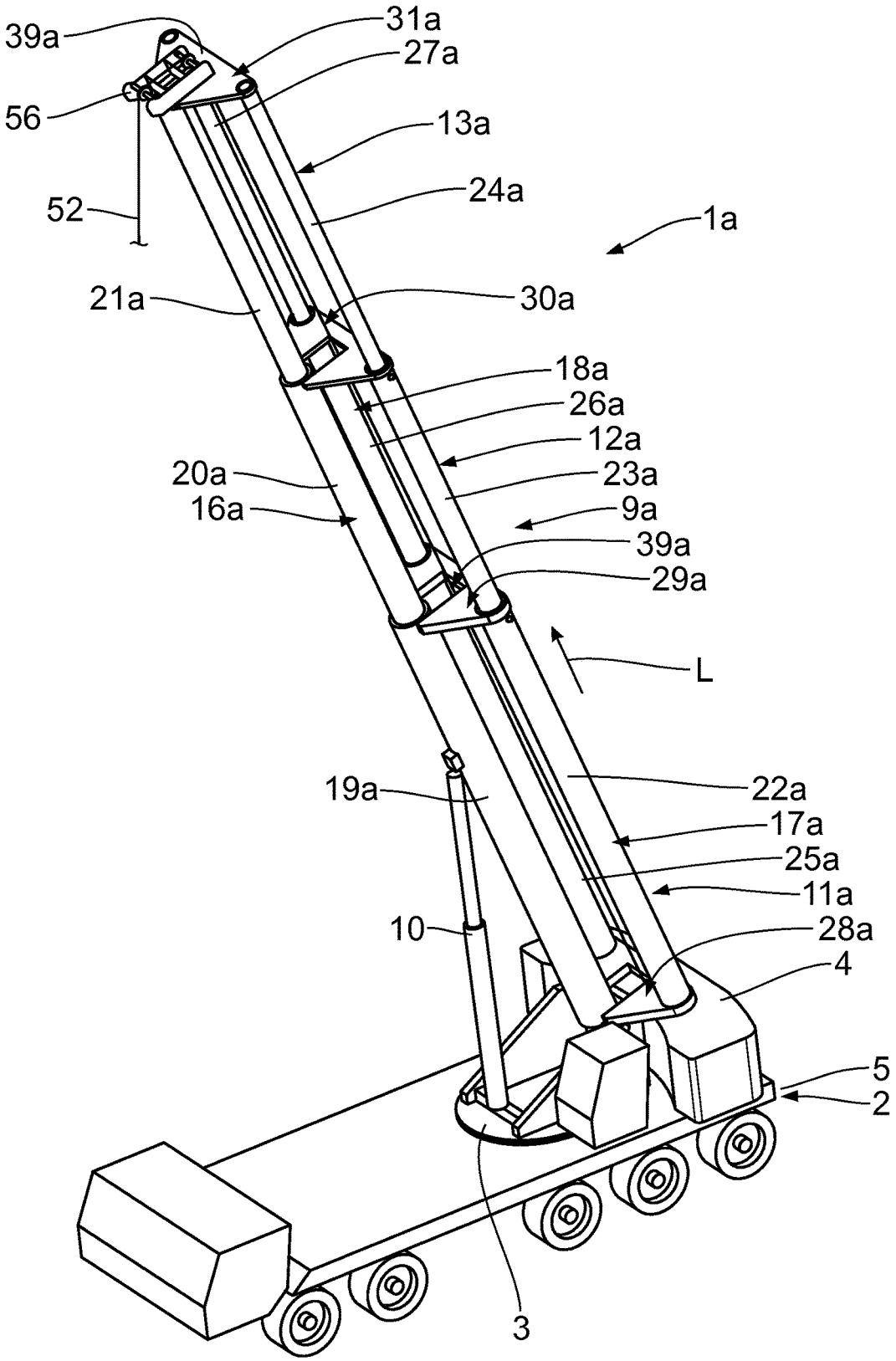
FIG. 7 shows a perspective view of a mobile telescopic crane according to a second embodiment with a jib, which is constructed from three part-jibs and which is in an extended operating position.
Figure 8:
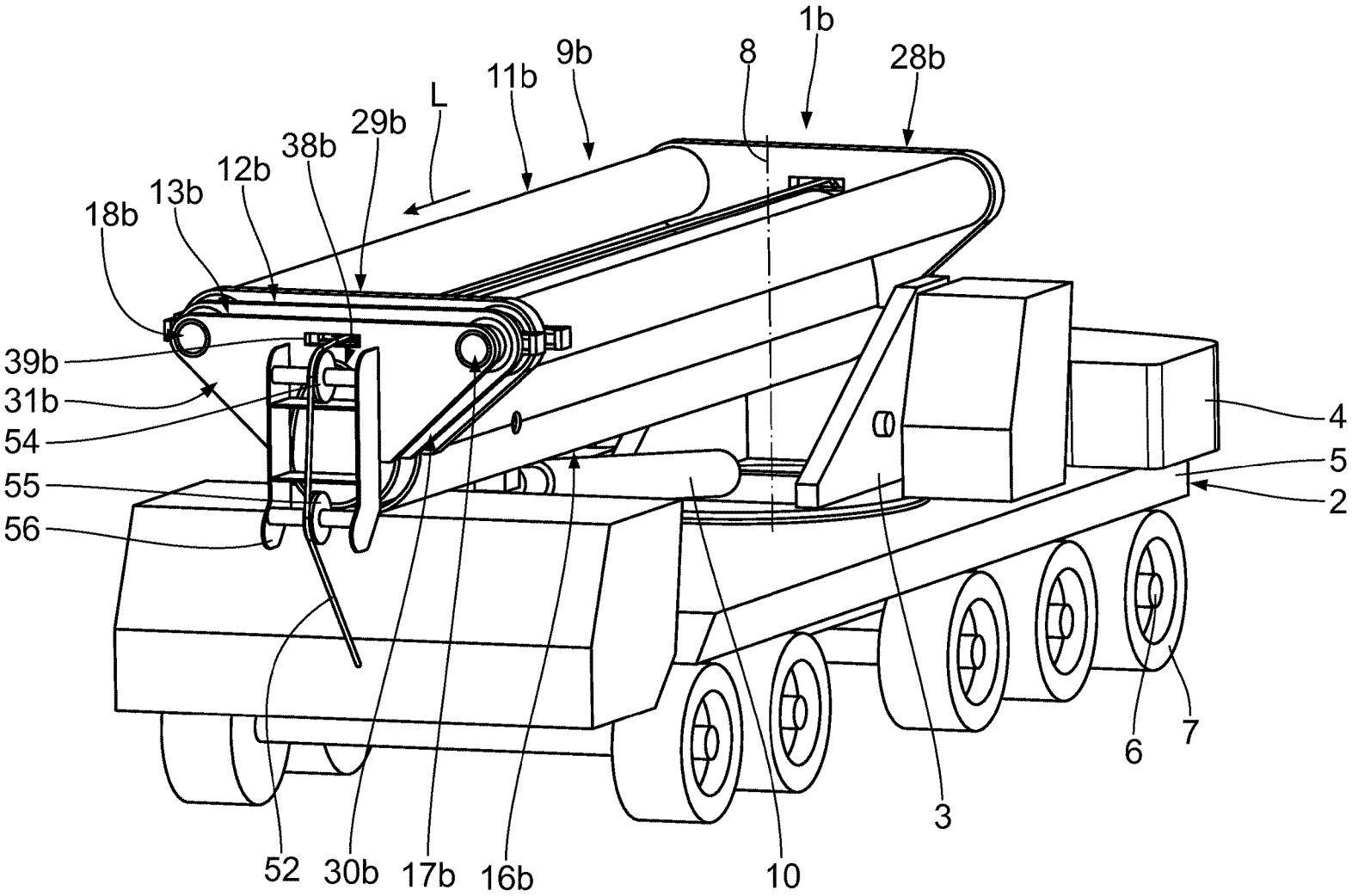
FIG. 8 shows a perspective view of a mobile telescopic crane according to a third embodiment with a jib, which is constructed from three part-jibs and is in a transporting position.
Figure 9:
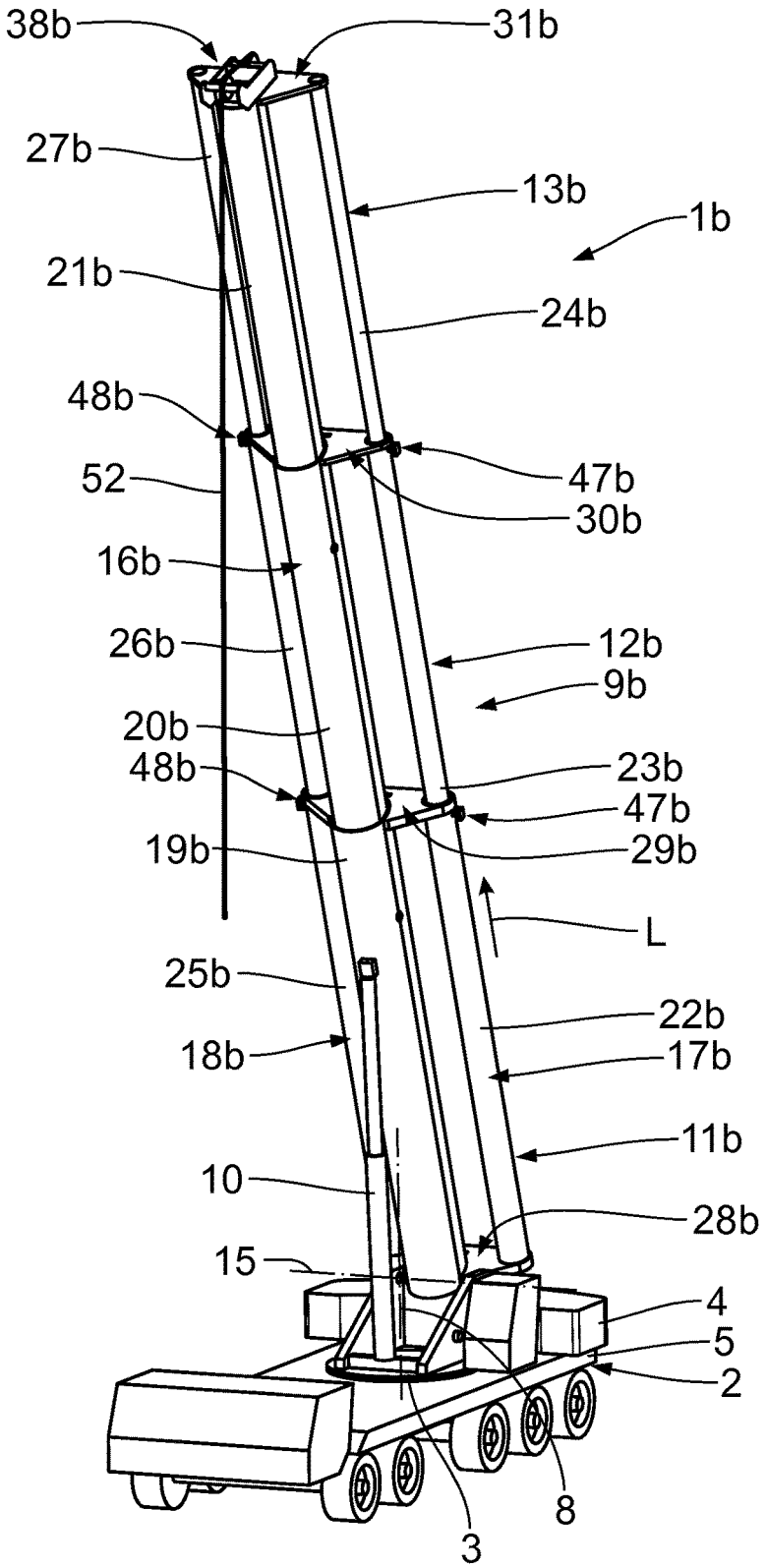
FIG. 9 shows a perspective view of the mobile telescopic crane in FIG. 8 with the jib in an extended operating position.
Figure 10:
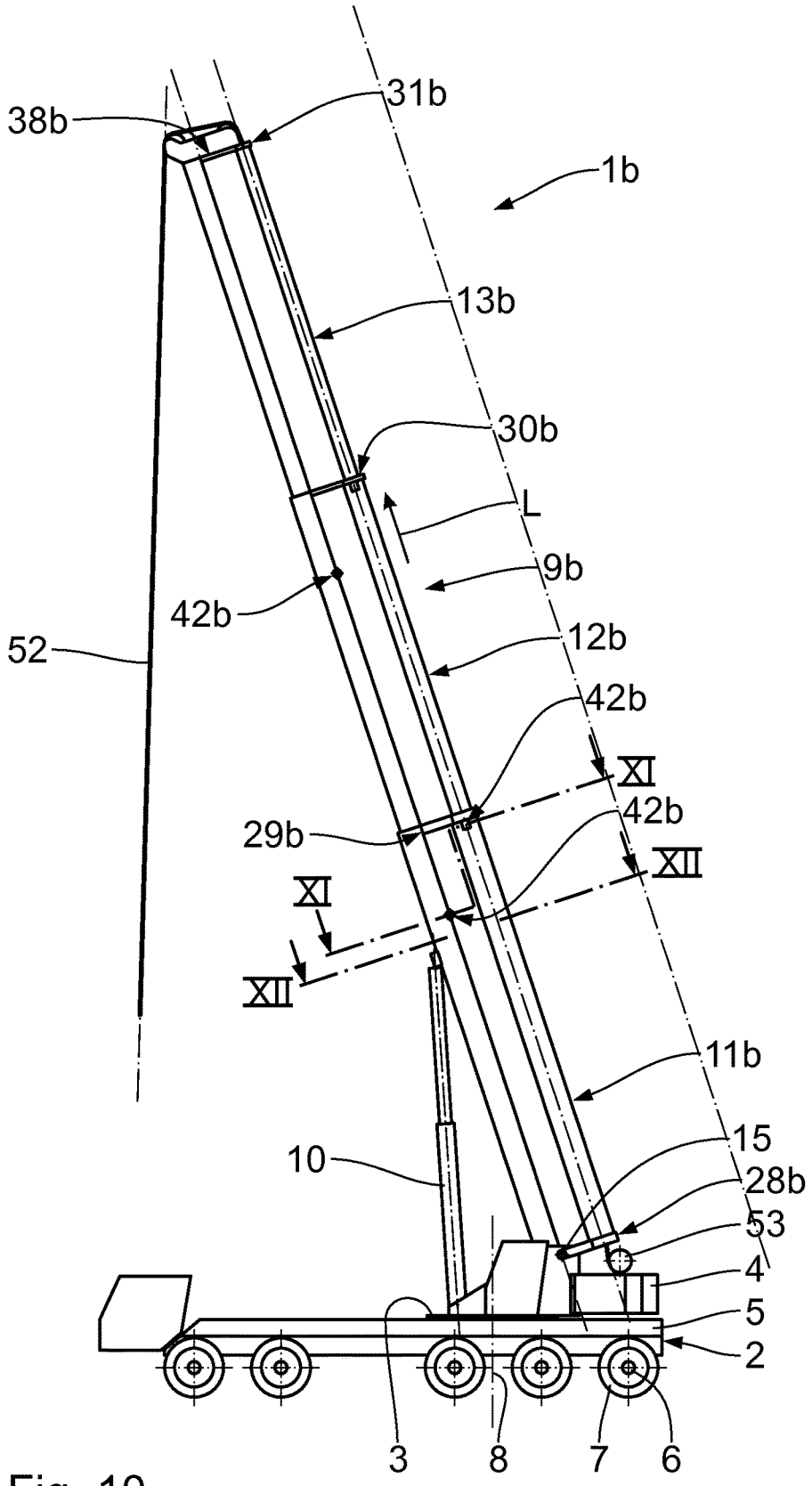
FIG. 10 shows a side view of the mobile telescopic crane in FIG. 9.
Figure 11:
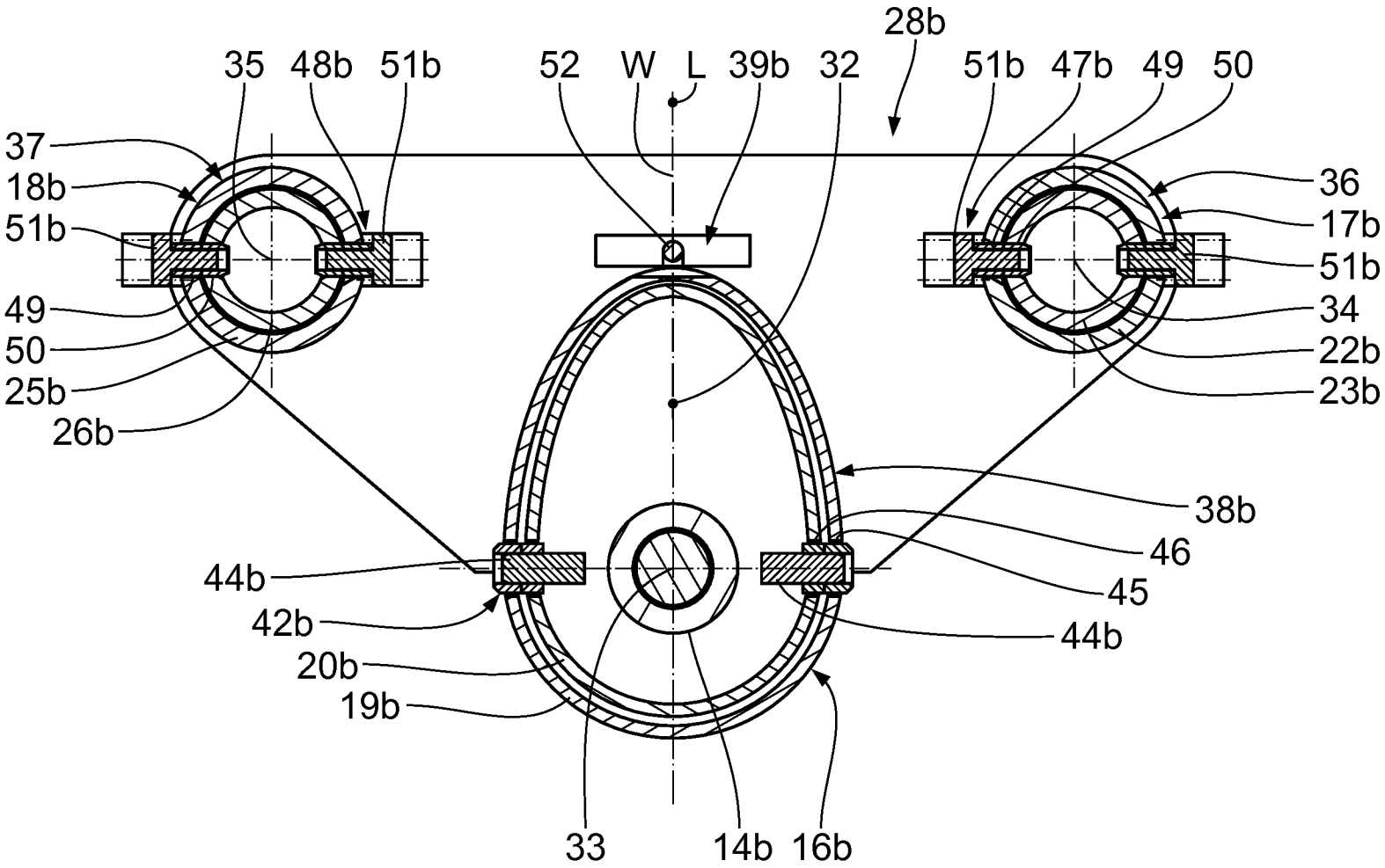
FIG. 11 shows a cross-section through the jib in FIG. 10 along the section line XI-XI.
Figure 12:
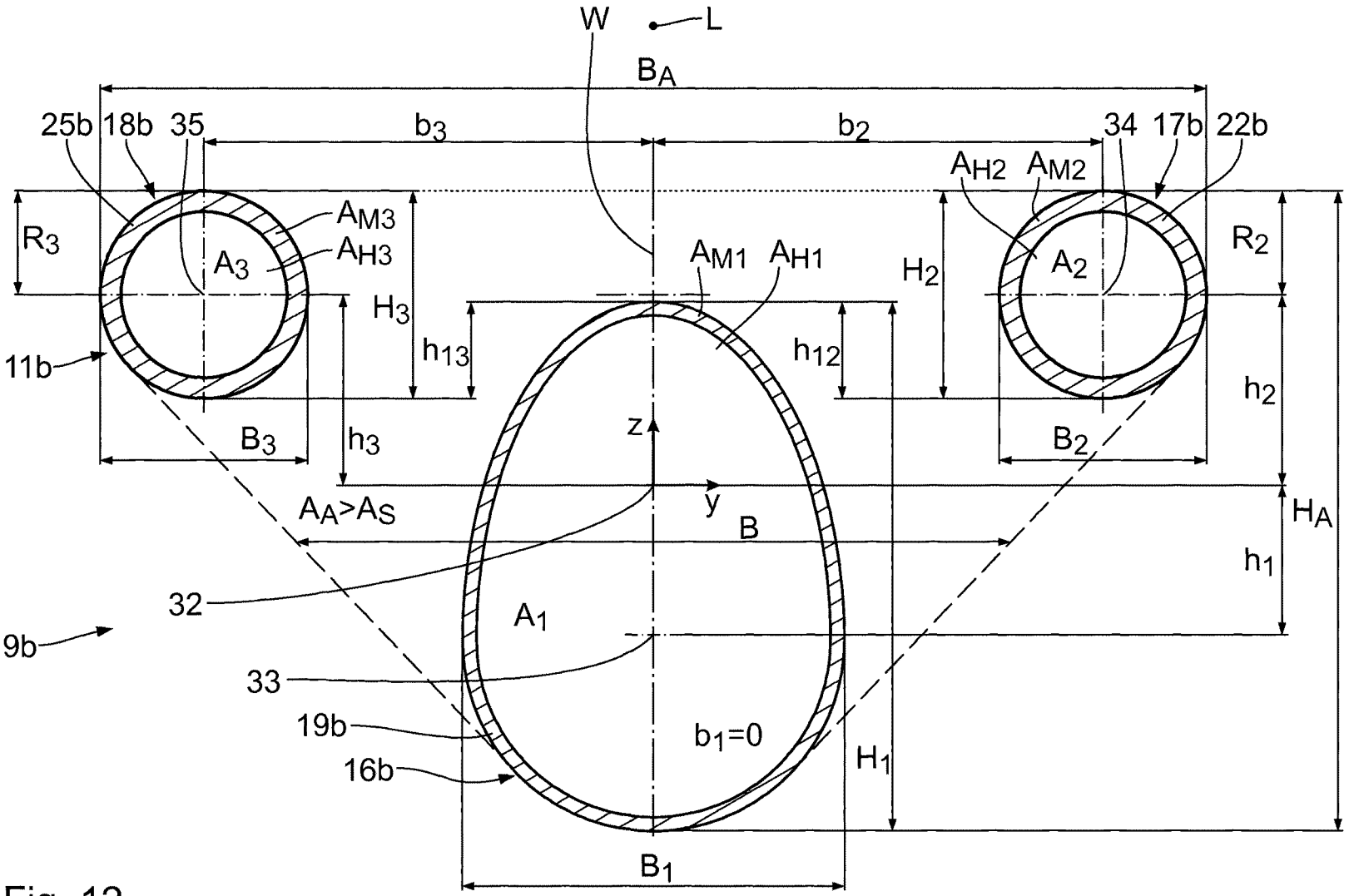
FIG. 12 shows a cross-section through the jib in FIG. 10 along the section line XII-XII.

A second embodiment of the invention will be described below with the aid of FIG. 7. In contrast to the first embodiment, the part-jibs 17*a*, 18*a* are rigidly arranged by means of the connecting elements 28*a* to 31*a* on the part-jib 16*a* and not displaceable relative thereto. If, as a result, the maximally permissible height of the mobile telescopic crane 1*a* is not exceeded, simplification of the structure of the jib 9*a* is thus possible. Since the connecting elements 28*a* to 31*a* are rigidly arranged on the part-jib 16*a*, the locking bores 43 can be dispensed with. With regard to the further structure and the further mode of functioning, reference is made to the description of the first embodiment.

A third embodiment of the invention will be described below with the aid of FIGS. 8 to 12. In contrast to the previous embodiments, the mobile telescopic crane 1*b* has a jib 9*b* with three part-jibs 16*b*, 17*b* and 18*b*, the part-jib 16*b* arranged in the luffing plane W having an oval cross-section. The connecting elements 28*b* to 31*b* accordingly have oval through-openings 38*b*. The cable guide channel 39*b* is configured in the connecting elements 28*b* to 31*b* above the part-jib 16*b* to guide the support cable 52. The part-jib centre longitudinal axis 33 of the part-jib 16*b* runs in the intersection point of the maximum height $H_1$ and the maximum width $B_1$ of the part-jib 16*b*.

The part-jib 16*b* arranged in the luffing plane W has a maximum width $B_1$ perpendicular to the luffing plane W and a maximum height $H_1$ in the luffing plane W, wherein there applies: $H_1/B_1>1$, in particular $H_1/B_1\geq1.2$, and, in particular $H_1/B_1\geq1.5$. The part-jib 16*b*, in the direction of the luffing plane W, overlaps with the part-jibs 17*b*, 18*b* with an overlap amount $h_{12}$ or $h_{13}$, wherein there applies $h_{12}=h_{13}$. There applies, furthermore, $h_{12}<R_2$ and $h_{13}<R_3$. The part-cross-sectional area $A_1$ is in each case greater than the part-cross-sectional area $A_2$ and $A_3$. There preferably applies $A_1/A_2\geq1.5$, in particular $A_1/A_2\geq2$, and, in particular $A_1/A_2\geq2.5$. The same applies to $A_1/A_3$. The jib 9*b*, in the region of the jib portion 11*b*, has a maximum height $H_A$, which is produced from the sum of $H_1$ and $R_2$ less the overlap amount $h_{12}$. Furthermore, the jib 9*b* in the region of the jib portion 11*b* has a maximum width $B_A$, which is produced from the sum of $R_2$, $R_3$, $b_2$ and $b_3$. The same is produced for the jib portions 12*b* and 13*b*, the external radii $R_2$ and $R_3$ and the maximum height $H_1$ and the overlap amount $h_{12}$ being correspondingly smaller because of the telescopic ability of the jib 9*b*.

The part-jibs 17*b*, 18*b*, corresponding to the second embodiment, are arranged at a fixed spacing from the part-jib 16*b*. Alternatively, the part-jibs 17*b*, 18*b*, corresponding to the first embodiment, can be displaced relative to the part-jib 16*b*. The hydraulic cylinder 14*b* is arranged within the part-jib 16*b* to telescope the jib 9*b*.

The locking units 47*b*, 48*b* are fastened directly to the connecting elements 29*b*, 30*b*, so adjacent part-jib portions 22*b* and 23*b*, 23*b* and 24*b*, 25*b* and 26*b* and 26*b* and 27*b* are mechanically lockable with respect to one another at the end. The locking units 47*b*, 48*b*, in each case, have two opposingly arranged locking bolts 51*b*, which can be guided through respective associated locking bores 49, 50. The locking bolts 51*b* can be actuated, for example, hydraulically, pneumatically or electromechanically.

The jib 9*b* has a high degree of flexural rigidity with respect to bending forces acting in the luffing plane W and bending forces acting perpendicular to the luffing plane W. The part-jib 16*b*, because of its oval cross-section and its part-cross-sectional area $A_1$, can, in particular, absorb high bending forces, which act in the luffing plane W. With respect to the further construction and the further mode of functioning of the mobile telescopic crane 1*b*, reference is made to the preceding embodiments.

The features of the jibs 9 to 9*b* can basically be combined in any way to form a jib according to the invention. Apart from the simple increasing of the bearing load by increasing the area moments of inertia, the jibs 9 to 9*b* according to the invention have further advantages compared to a conventional jib with anchoring supports. The jibs 9 to 9*b* according to the invention, in each jib portion 11 to 13*b*, can be optimized separately with respect to the acting bending forces, so these are continuously absorbed along the jib 9 to 9*b* and not only at the end of the jib. Moreover, both the transfer of the jibs 9 to 9*b* into the operating position and their operation are extremely simple. In particular, no laborious control of the pretensioning force of the anchoring cables is necessary, so the operation is simplified and the reliability is simultaneously increased, as no incorrect control of the pretensioning force is possible. A large number of optimizing parameters are provided by means of the number of part-jibs 16 to 17*b* and their arrangement and spacing with respect to one another, whereby the cross-sectional area $A_A$ is defined, and by means of the cross-sectional form and the part-cross-sectional areas $A_A$ so a jib 9 to 9*b* according to the invention can be optimized with respect to the capacity to absorb bending forces acting perpendicular to and in the luffing plane W and with respect to the weight. In total, the jibs 9 to 9*b* according to the invention allow a substantial increase in the bearing load at a predefined weight compared to conventional jibs. In particular, with the same bearing load, substantially easier handling of the jibs 9 to 9*b* is possible with respect to transportation and assembly or transfer into the operating position compared with conventional jibs with anchoring supports.

What is claimed is:

1. A mobile telescopic crane comprising:

a movable undercarriage, a superstructure rotatably arranged on the undercarriage, a jib mounted on the superstructure wherein the jib is telescopic in a longitudinal direction, and is pivotable in a luffing plane, wherein the telescopic jib has at least three part-jibs, wherein each of the at least three part-jibs is constructed from at least two part-jib portions that are telescopic in the longitudinal direction, wherein the part-jib portions are arranged at a spacing from one another transverse to the longitudinal direction to form a jib portion with at least one rigid connecting element, wherein respective adjacent jib portions are mechanically lockable with respect to one another in the longitudinal direction, wherein the jib has three part-jibs which are arranged triangularly and symmetrically with respect to the luffing plane, and wherein one part-jib of the three part-jibs is arranged in the luffing plane and has a larger part-cross-sectional area than the other part-jibs.

2. A mobile telescopic crane according to claim 1, wherein the jib, perpendicular to the luffing plane, has a cross-sectional area $A_A$ produced by the at least three part-jibs and each of the at least three part-jibs, perpendicular to the luffing plane, has a part-cross-sectional area, wherein the ratio of the cross-sectional area $A_A$ to a sum $A_S$ of the part-cross-sectional areas is $A_A/A_S \geq 1$.

3. A mobile telescopic crane according to claim 1 wherein the jib, perpendicular to the luffing plane, has a width $B_A$, and each of the part-jibs has a width $B_1$ and $B_A/B_i \geq 1.5$.

4. A mobile telescopic crane according to claim 1, wherein the jib, parallel to the luffing plane, has a height $H_A$ and each of the part-jibs has a height $H_i$, and the ratio $H_A/H_i \geq 1.2$.

5. A mobile telescopic crane according to claim 1, wherein respective adjacent part-jib portions of all the part-jibs are mechanically lockable with respect to one another in the longitudinal direction.

6. A mobile telescopic crane according to claim 1, wherein at least two adjacent part-jib portions are mechanically lockable with respect to one another by means of at least one locking bolt.

7. A mobile telescopic crane according to claim 1, wherein at least two adjacent part-jib portions are mechanically lockable with respect to one another by means of at least two locking bolts.

8. A mobile telescopic crane according to claim 1, wherein the jib has a width that changes perpendicular to the luffing plane, the width increasing from a lower part-jib facing the undercarriage up to two upper part-jibs remote from the undercarriage.

9. A mobile telescopic crane according to claim 1, wherein the part-jib arranged in the luffing plane is arranged on a lower side of the jib and the other part-jibs are spaced apart from the luffing plane and are arranged on an upper side of the jib.

10. A mobile telescopic crane according to claim 1, wherein the part-jibs arranged spaced apart from the luffing plane have the same cross-sections and the same cross-sectional areas.

11. A mobile telescopic crane according to claim 1, wherein the part-jib arranged in the luffing plane has a cross-section, at least in portions, which is selected from the group consisting of circular and oval.

12. A mobile telescopic crane according to claim 1, wherein the part-jib arranged in the luffing plane forms a receiving space, and a hydraulic cylinder is arranged in the receiving space to telescope the jib.

13. A mobile telescopic crane according to claim 1, wherein respective adjacent part-jib portions of the part-jibs arranged spaced apart from the luffing plane are mechanically lockable with respect to one another at an end.

14. A mobile telescopic crane according to claim 1, wherein the part-jibs define a cable guide channel.

15. A mobile telescopic crane according to claim 1, wherein a support cable is guided along the jib.

16. A mobile telescopic crane according to claim 1, wherein respective adjacent part-jib portions of the part-jibs which are spaced apart from the luffing plane are mechanically lockable with respect to one another at an end, and at least one locking bolt is provided to lock adjacent part-jibs and is mounted on a rigid connecting element.

17. A mobile telescopic crane according to claim 1, wherein a support cable is arranged in a cable guide channel in the jib.

* * * * *